US006089664A

United States Patent [19]

Yoshida

[11] Patent Number: 6,089,664

[45] Date of Patent: Jul. 18, 2000

[54] SUPPORT FOR BACKREST AND SEAT OF SEAT FURNITURE

[76] Inventor: Atsuo Yoshida, Bell-Mezzon Esperance Karibadai-304 800-10, Karibacho Hodogaya-ku, Yokohama-shi, Kanagawa-ken, Japan, 240-0025

[21] Appl. No.: 09/117,311

[22] PCT Filed: Jan. 27, 1997

[86] PCT No.: PCT/JP97/00172

§ 371 Date: Jul. 27, 1998

§ 102(e) Date: Jul. 27, 1998

[87] PCT Pub. No.: WO97/26810

PCT Pub. Date: Jul. 31, 1997

[30] Foreign Application Priority Data

Jan. 27, 1996 [JP] Japan ..... 8-001248

[51] Int. Cl.[7] ..... A47C 3/025

[52] U.S. Cl. ..... 297/284.4; 297/112; 297/284.3

[58] Field of Search ..... 297/112, 284.3, 297/284.4, 284.5, 284.1

[56] References Cited

U.S. PATENT DOCUMENTS

| | | | |
|---|---|---|---|
| 1,527,754 | 2/1925 | Simon | 601/24 X |
| 2,485,111 | 10/1949 | Robins | 155/5 X |
| 2,742,957 | 4/1956 | Young | 155/179 X |
| 3,565,482 | 2/1971 | Blodee | 297/284 |
| 4,601,514 | 7/1986 | Meiller | 297/284.4 |
| 4,826,247 | 5/1989 | McGrady et al. | 297/314 X |
| 4,911,502 | 3/1990 | Gorman | 297/460 X |
| 4,981,325 | 1/1991 | Zacharkow | 297/284 |
| 5,389,064 | 2/1995 | Cohen | 602/19 X |
| 5,501,507 | 3/1996 | Hummitzsch | 297/284.4 |
| 5,507,559 | 4/1996 | Lance | 297/284.5 |
| 5,718,476 | 2/1998 | De Pascal et al. | 297/284.4 |
| 5,823,620 | 10/1998 | Le Caz | 297/284.4 |

FOREIGN PATENT DOCUMENTS

| | | | |
|---|---|---|---|
| 696502 | 10/1964 | Canada | 297/284.4 |
| 518830 | 12/1992 | European Pat. Off. | 297/284.4 |
| 540481 A1 | 5/1993 | European Pat. Off. | 297/284.4 |
| 63-156629 | 10/1988 | Japan . | |
| 1280414 | 11/1989 | Japan . | |
| 1280415 | 11/1989 | Japan . | |
| 849798 | 9/1960 | United Kingdom | 297/284 |
| 21654485 | 4/1986 | United Kingdom | 297/284.4 |

*Primary Examiner*—Lynne H. Browne
*Assistant Examiner*—Brian H. Buck
*Attorney, Agent, or Firm*—Andrus, Sceales, Starke & Sawall

[57] ABSTRACT

A back and waist support device mounted on a seating furniture equipment such as, for example, a chair or a legless chair is disclosed. The device includes a first arm for supporting a longitudinally extending first projection arranged for forcedly pressing the back of a user and a second arm for supporting a longitudinally extending second projection arranged for forcedly pressing his waist, as well as springs arranged on the first arm and second arm so as to urge the first projection and second projection in a direction of forcedly pressing the back and waist, respectively, resulting in being constructed in a manner to be pivotally movable. The first and second arms per se each may be constructed into an elastic structure, to thereby eliminate arrangement of the springs. Also, an angle between the first arm and the second arm may be adjustable. Such construction permits the first projection and second projection to effectively forcedly press the back of a user and his waist irrespective of a posture of the user such as, for example, his sitting with a slouch, his sitting forward on a seat or the like, so that the user may throw out his chest and stretch his backbone while relaxing his body, resulting in relieving his fatigue.

6 Claims, 9 Drawing Sheets

SUPPORT FOR BACKREST AND SEAT OF SEAT FURNITURE

TECHNICAL FIELD

This invention relates to a back and waist support device for a seating furniture equipment, and more particularly such a back and waist support device adapted to press the back and waist of a user to permit the user to throw out his chest, so that the user may straightly stretch his backbone to correct his posture and concurrently may safely support his waist without any burden thereon.

BACKGROUND ART

In general, a seating furniture equipment such as a chair, a sitting or legless chair, or the like is constructed so as to permit a user to comfortably sit thereon when he leans or rests against a backrest of the seating furniture equipment. However, when the user sits on the seating furniture equipment while stooping or sits forward on the equipment, resulting in his posture being unnatural, the equipment causes him to be simply tired, resulting in the user failing to comfortably sit on the equipment for a long period of time and his health being adversely affected.

Thus, it is desired that a user sits on the seating furniture equipment while keeping his chest thrown out, his backbone straightly stretched and his body relaxed to the utmost. This permits the user to relieve his fatigue and relax his body. Also, such a seated posture permits the user to relax his muscle and nerve, so that he may get rid of stress.

Unfortunately, in general, it is highly difficult for the user to take a posture of throwing out his chest and straightly stretching his backbone during his sitting.

In view of the foregoing, the applicant proposed a seating furniture equipment constructed as shown in FIGS. 1 and 2. More particularly, the seating furniture equipment proposed includes a longitudinally extending or elongated projection for concurrently supporting the back M and waist H of a user M. The longitudinally extending projection includes a first longitudinal projection member x for supporting the back B of the user and a second longitudinal projection member y for supporting his waist H which are arranged separately from each other, as well as an angle adjusting mechanism z arranged therebetween. The first and second projection members x and y are connected to each other through the angle adjusting mechanism z in a manner to be pivotable in relation to each other and held at a desired angle with respect to each other. The proposed seating furniture equipment is disclosed in Japanese Patent Applications Nos. 153428/1988 and 201035/1988.

The seating furniture equipment proposed is constructed so as to concurrently support both back B and waist H of a user, so that he may comfortably sit on the seating furniture equipment for a long period of time without being tired; because it permits the user to throw out his chest and stretch his backbone, to thereby relax his body during his sitting. Thus, the user may relieve his fatigue.

The seating furniture equipment is so constructed that the first projection member x is fixed. Thus, it exhibits an effective function when the user sits on the seating furniture equipment while forcing or leaning his back against the first projection member x as shown in FIG. 2. However, when the user sits on the equipment with a slouch, for example, while resting his elbows upon a desk, it causes separation of the back B of the user from the first projection member x, resulting in failing to permit the first projection member x to effectively force the back B. Also, the first and second projection members x and y are arranged so as to extend in a longitudinal or vertical direction. Such arrangement exhibits an effective action because it permits the user's chest to be thrown out when the user sits on the equipment while leaning the back B and/or waist H against a backrest of the equipment. However, in this instance, it lightly contacts the first and second projection members x and y with the back B and waist H without pressedly forcing the former against the latter, resulting in failing to exhibit a significant massage action or pressure therapy.

In view of the foregoing, an object of the present invention to provide a back and waist support device for a seating furniture equipment which is capable of effectively forcedly pressing the back and waist of a user by arranging arms so as to support a first projection and a second projection and arranging springs on the arms so as to urge the arms in a direction in which the first and second projections are forcedly pressed against the back and waist of the user.

It is another object of the present invention to provide a back and waist support device for a seating furniture equipment which it so constructed that arms each act as an elastic means or an angle between the arms is adjustable.

It is a further object of the present invention to provide a back and waist support device for a seating furniture equipment which is so constructed that first and second projections are varied in configuration or exhibit a massage action or arms are varied in length in conformity to a physique of a user or his figure.

DISCLOSURE OF INVENTION

In accordance with the present invention, a back and waist support device for a seating furniture equipment is provided. The seating furniture equipment includes a spring for urging a first projection for supporting the backbone of a user in a direction in which the first projection presses his back and a spring for urging a second projection for supporting his waist in a direction in which the second projection presses the waist. Such arrangement of the springs permits the first and second projections to forcedly press the back and waist by elastic force of the springs when the user merely sits in the seating furniture equipment, so that he may naturally thrown out his chest and stretch his backbone.

Also, the present invention may be constructed in such a manner that the arms per se may exhibit elastic force rather than arrangement of the springs. Also, an angle between the first arm and the second arm may be adjustable. Alternatively, the angle may be kept constant or fixed. In any event, such construction exhibits an effective massage function.

BEST MODES FOR CARRYING OUT INVENTION

Now, a back and waist support device for a seating furniture equipment according to the present invention will be described in detail with reference to the accompanying drawings.

Figure 1:
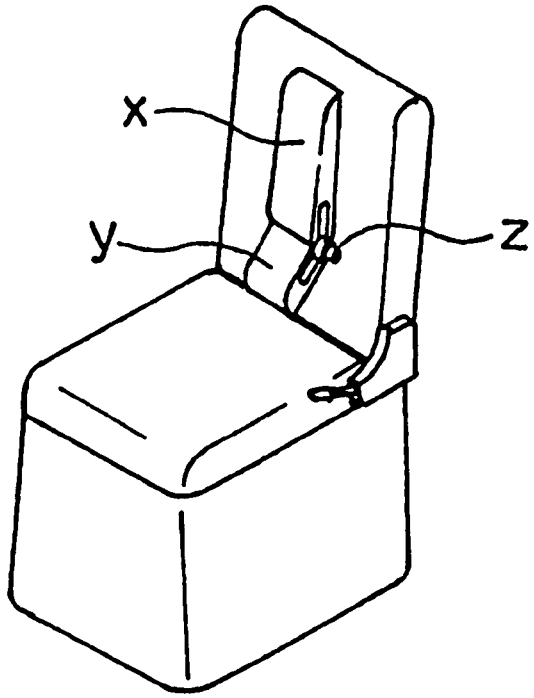
FIG. 1 PRIOR ART
FIG. 1 is a perspective view showing a conventional seating furniture equipment including a first projection member and a second projection member.
Figure 2:
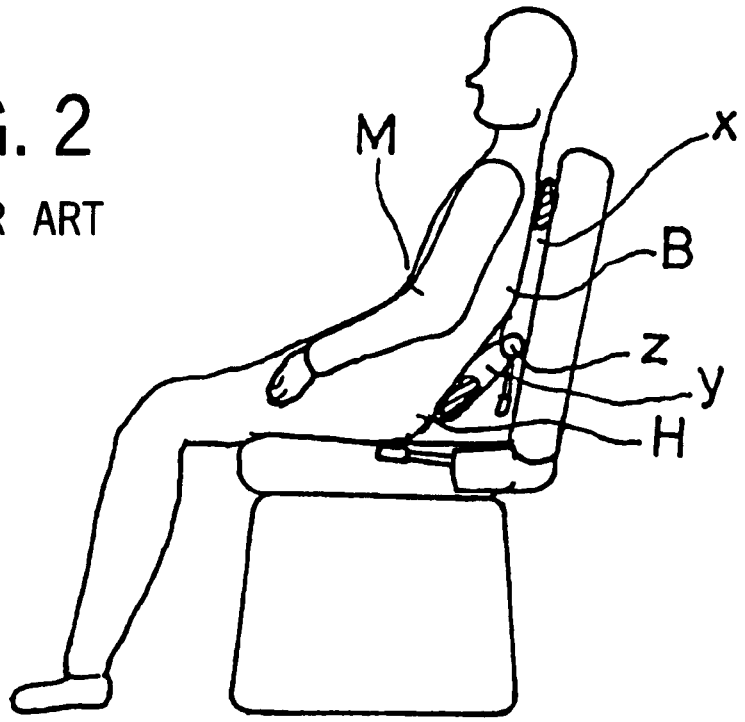
FIG. 2 PRIOR ART
FIG. 2 is a side elevation view showing the manner of operation of the conventional seating furniture equipment of FIG. 1.
Figure 3:
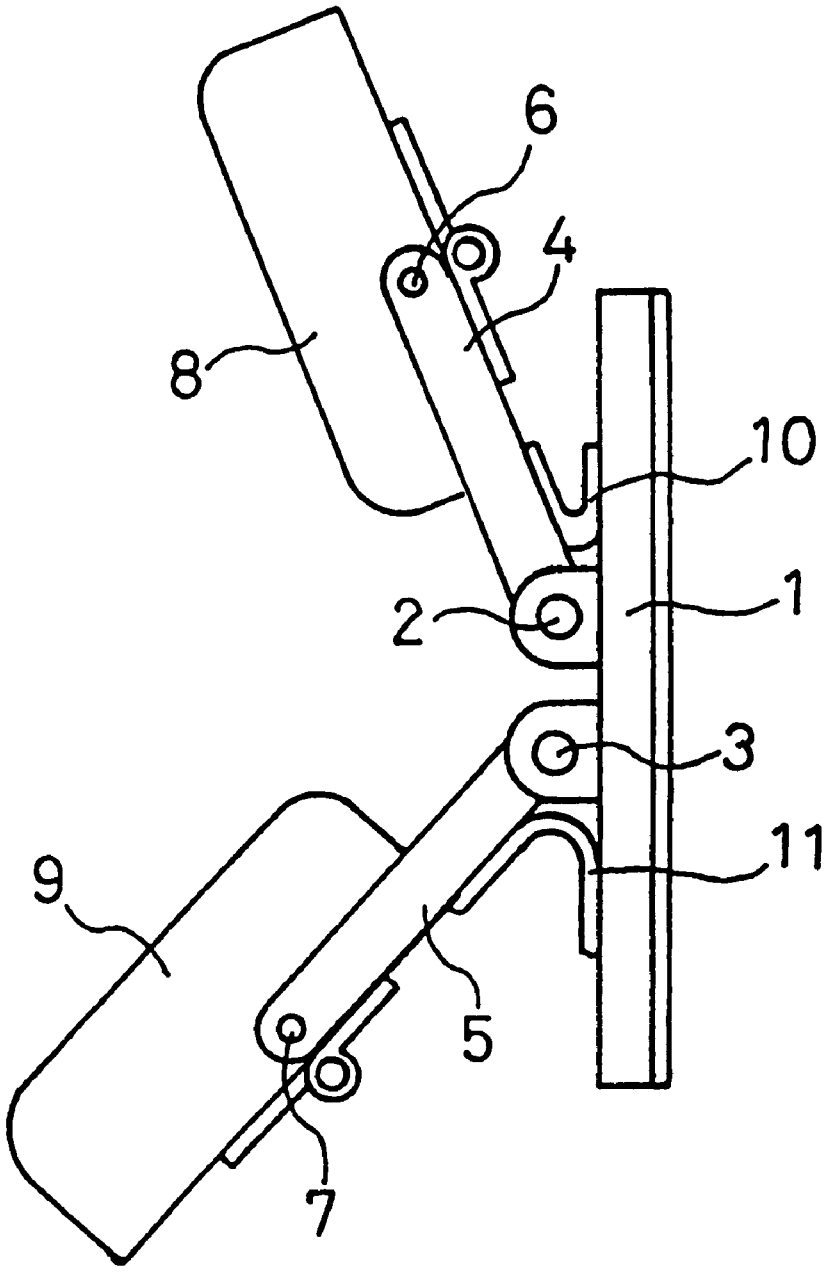
FIG. 3 is a side elevation view showing a first embodiment of a back and waist support device for a seating furniture equipment according to the present invention.

Referring first to FIG. 3, a first embodiment of a back and waist support device for a seating furniture equipment according to the present invention is illustrated. A back and waist support device of the illustrated embodiment includes a base plate 1 mounted at any desired vertical position on a backrest of a seating furniture equipment or, for example, a chair by means of a commercially available detachable mounting element. Also, the back and waist support device includes a first arm 4 and a second arm 5 pivotably mounted at one end thereof through shafts 2 and 3 on the base plate 1, respectively. The first arm 4 and second arm 5 are mounted at the other end thereof or a free end thereof with a longitudinally extending first projection 8 for supporting a backbone of a user and a second longitudinally extending second projection 9 for supporting a waist of the user through shafts 6 and 7, respectively. The first projection 8 and second projection 9 may be fixedly mounted on the first arm 4 and second arm 5, respectively. However, as shown in FIG. 3, the projections 8 and 9 may be mounted on the shafts 6 and 7 in a manner to be pivotally moved about the shafts 6 and 7, respectively. Such latter construction permits an angle of the first projection 8 and second projection 9 to be desirably variably adjusted or set when the first and second projections forcedly press the back and waist.

The first projection 8 and second projection 9 each are constituted of an elastic member made of urethane foam or the like and an outer packaging sheet member such as fabric, vinyl leather or the like for covering the elastic member. The first projection 8 and second projection 9 may be formed into any suitable shape in section such as, for example, a rectangle, a trapezoid, a semicircle or the like so long as they are projected toward the back and waist.

The back and waist support device of the illustrated embodiment also includes springs 10 and 11 which are arranged between the first arm 4 and the base plate 1 and between the second arm 5 and the base plate 1 so as to elastically force the first arm 4 and second arm 5 in a direction in which the first projection 8 and second projection 9 are forcedly pressed against the back and waist of a user sitting on the equipment, respectively. In the illustrated embodiment, the spring 10 is arranged so as to force the first arm 4 in a counter-clockwise direction in FIG. 3 and the spring 11 is arranged so as to urge the second arm 5 in a clockwise direction. Thus, the first projection 8 and second projection 9 are permitted to be forcedly pressed against the back and waist of the user by elastic force of the springs 10 and 11, when he sits on the seating furniture equipment, resulting in the back and waist of the user being rested upon the projections 8 and 9.

Thus, when the user sits on the seating furniture equipment to rest his back and waist on the first and second projections 8 and 9, respectively, the projections permit a pressure to act on the back and waist using elastic force of the springs 10 and 11, to thereby exhibit a massage function.

Figure 4:
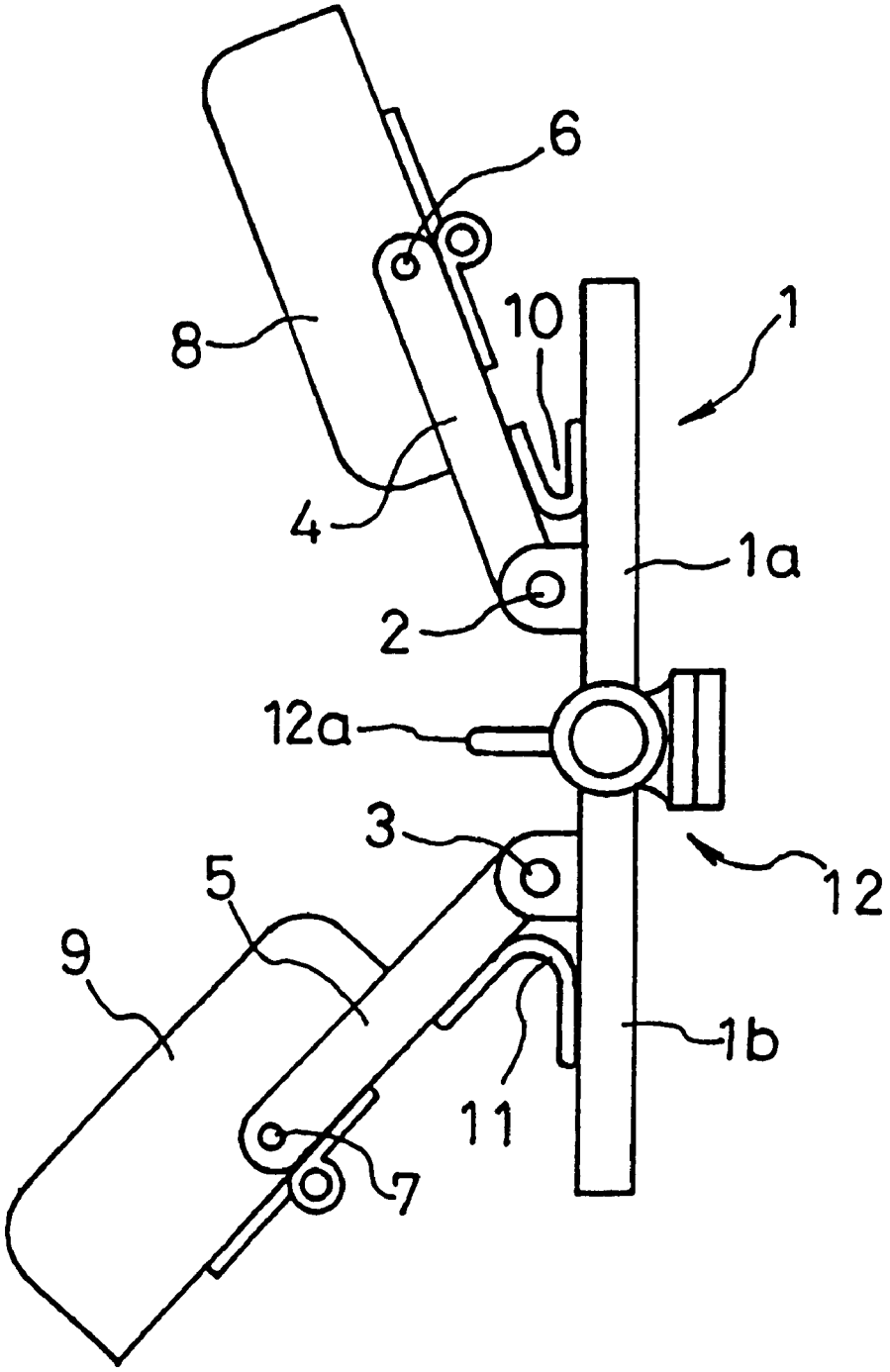
FIG. 4 is a side elevation view showing a second embodiment of a back and waist support device for a seating furniture equipment according to the present invention.

Referring now to FIG. 4, another embodiment of a back and waist support device for a seating furniture equipment according to the present invention is illustrated, which is directed to an improvement in the back and waist support device shown in FIG. 3. More specifically, a base plate 1 is divided into two base plate members 1*a* and 1*b*, which are pivotally connected to each other through an angle adjusting mechanism 12 and held at any desired angle therethrough.

The embodiment described above with reference to FIG. 3 is so constructed that the first projection 8 and second projection 9 may be held in position under a balance of elastic force between the springs 10 and 11. Use of only elastic force of the springs 10 and 11 in the embodiment of FIG. 3 causes force at which the first and second projections 8 and 9 press the back and waist to be proportionally varied depending on an angle of pivotal movement of the first and second arms 4 and 5.

More particularly, positioning of the first and second arms 4 and 5 while keeping an angle therebetween reduced causes force at which the first projection 8 presses the back of the user to be reduced, whereas that while keeping the angle increased causes the force to be increased. This is likewise true of force at which the second projection 9 presses the waist of the user.

In the embodiment of FIG. 4, as described above, the base plate 1 is vertically divided into two such base plate members 1*a* and 1*b* and the angle adjusting mechanism 12 is arranged therebetween so as to hold the base plate members 1*a* and 1*b* relative to each other at any desired angle. Such construction permits an angular interval between the first arm 4 and the second arm 5 and therefore that between the first projection 8 and the second projection 9 to be set as desired.

The angle adjusting mechanism 12 may be constructed in any suitable manner such as, for example, a manner of carrying out rotation of a ratchet gear in both normal and reverse directions by means of a lover 12*a*.

Figure 5:
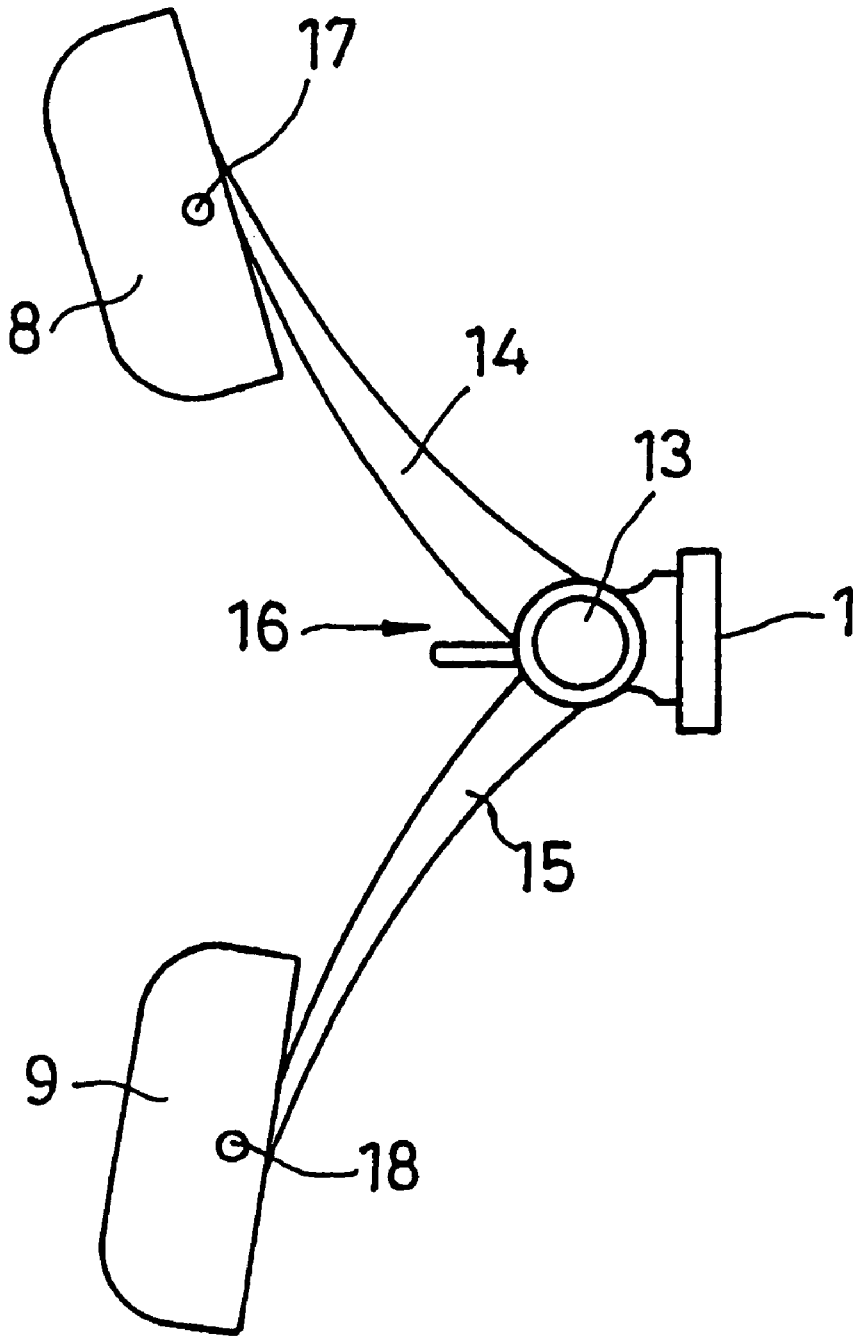
FIG. 5 is a side elevation view showing a third embodiment of a back and waist support device for a seating furniture equipment according to the present invention.

Referring now to FIG. 5, a further embodiment of a back and waist support device for a seating furniture equipment according to the present invention is illustrated. A back and waist support device of the illustrated embodiment is so constructed that a base plate 1 mounted on a backrest of a seating furniture equipment in the form of a chair is pivotably mounted thereon with a first arm 14 and a second arm 15 through a single shaft 13. Also, in the illustrated embodiment, the first arm 14 and second arm 15 per se each are made of an elastic material. A base plate 1 may be divided into two base plate members of which an angle is adjustable as in the embodiment shown in FIG. 4. However, in the illustrated embodiment, an angle adjusting mechanism 16 is mounted on the shaft 13.

Preferably the first arm 14 and second arm 15 may be made of such an elastic steel or plastic material as widely used for a spring, resulting in exhibiting satisfactory elasticity and tapered as required as shown in FIG. 5. Also, a first projection 8 and a second projection 9 may be desirably arranged in a manner to be pivotally movable about shafts 17 and 18, respectively, as shown in FIG. 5.

Figure 6:
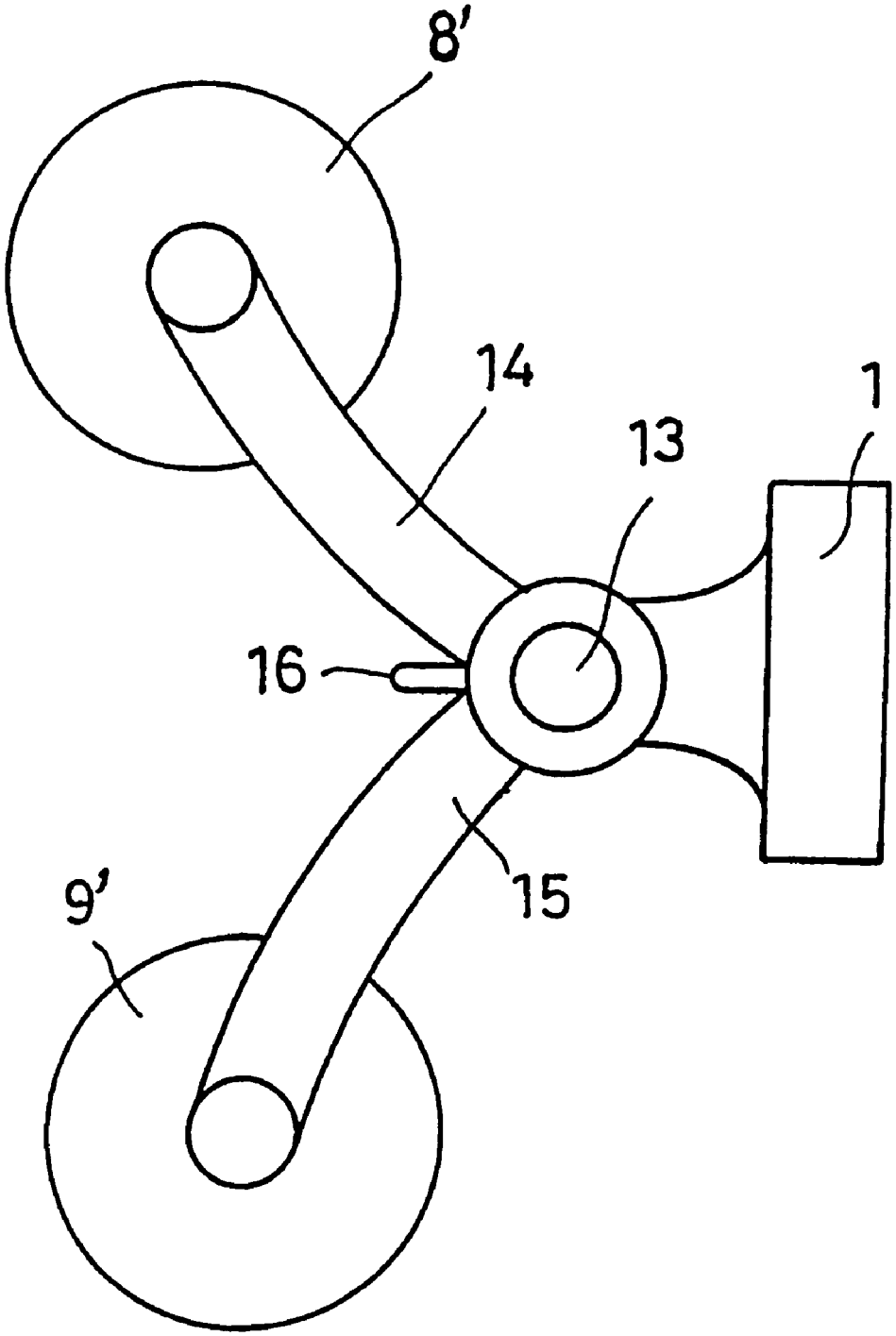
FIG. 6 is a side elevation view showing a fourth embodiment of a back and waist support device for a seating furniture equipment according to the present invention.

Referring now to FIG. 6, still another embodiment of a back and waist support device for a seating furniture equipment according to the present invention is illustrated. In the illustrated embodiment, a first projection 8' and a second projection 9' each are formed into a cylindrical shape. Such configuration of the first and second projections 8' and 9' permits a feeling of contact of the body of a user with the projections to be kept unvaried irrespective of a degree of opening of the first am 14 and second arm 15. In this instance, the first projection 8' and second projection 9' are intended to act on a center of the back of the user (his lumber, thoracic vertebrae and backbone) and on his waist, respectively, thus, they are desirably formed into a reduced width.

Figure 7:
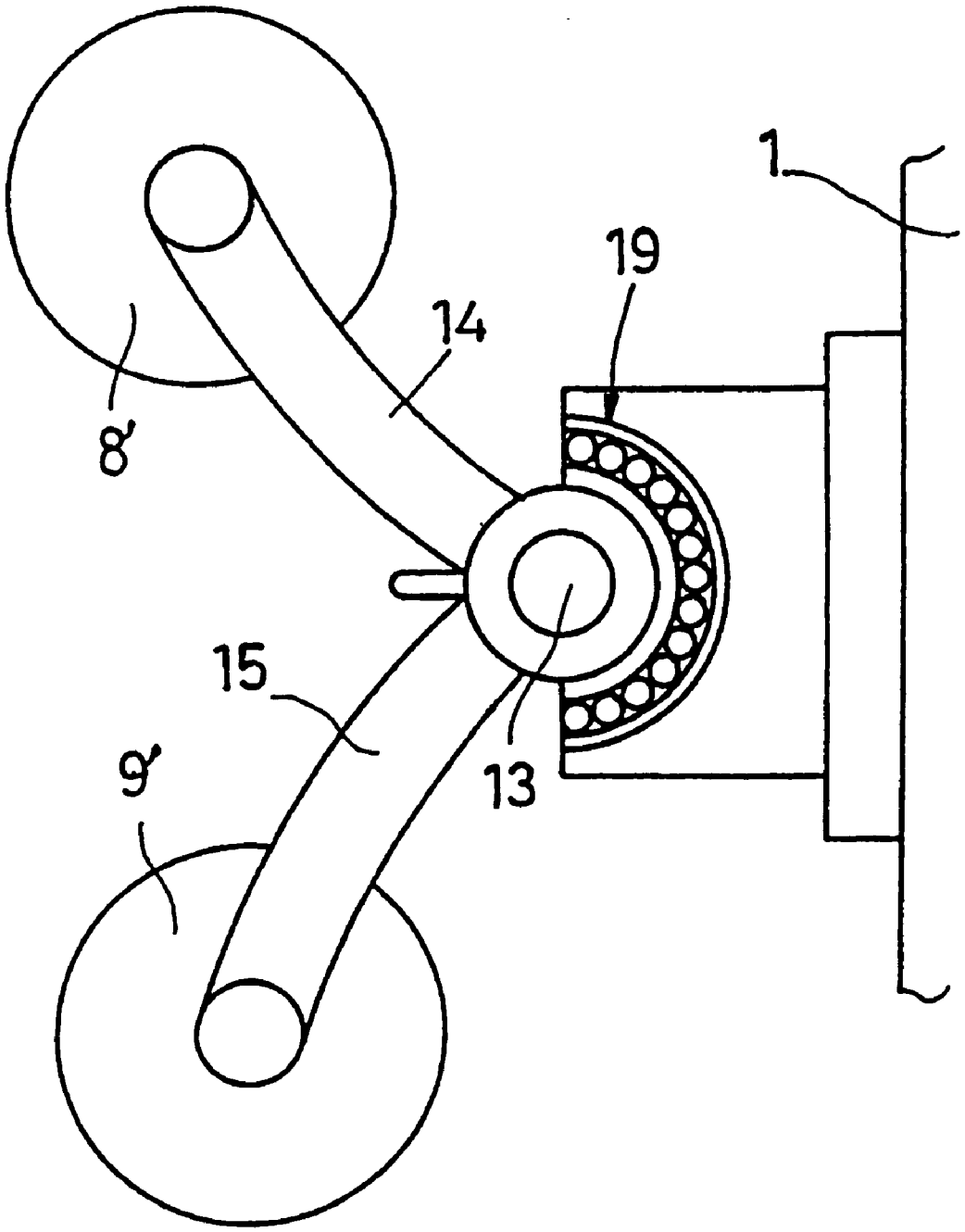
FIG. 7 is a side elevation view showing a fifth embodiment of a back and waist support device for a seating furniture equipment according to the present invention.

Referring now to FIG. 7, yet another embodiment of a back and waist support device for a seating furniture equipment according to the present invention is illustrated. In the illustrated embodiment, a shaft 13 is arranged in a manner to be rotatable while keeping a first arm 14 and a second arm 15 at a constant angle. More specifically, in the illustrated embodiment, the shaft 13 is supported on a plain or slide bearing 19, so that a balance of force between a first projection 8' and a second projection 9' may be ensured, resulting in a feeling in use of a seating furniture equipment being improved and positional relationship between the first and second projections 8' and 9' and a backrest of the equipment being balanced irrespective of an angle of the backrest and motion of the body of a user.

Figure 8:
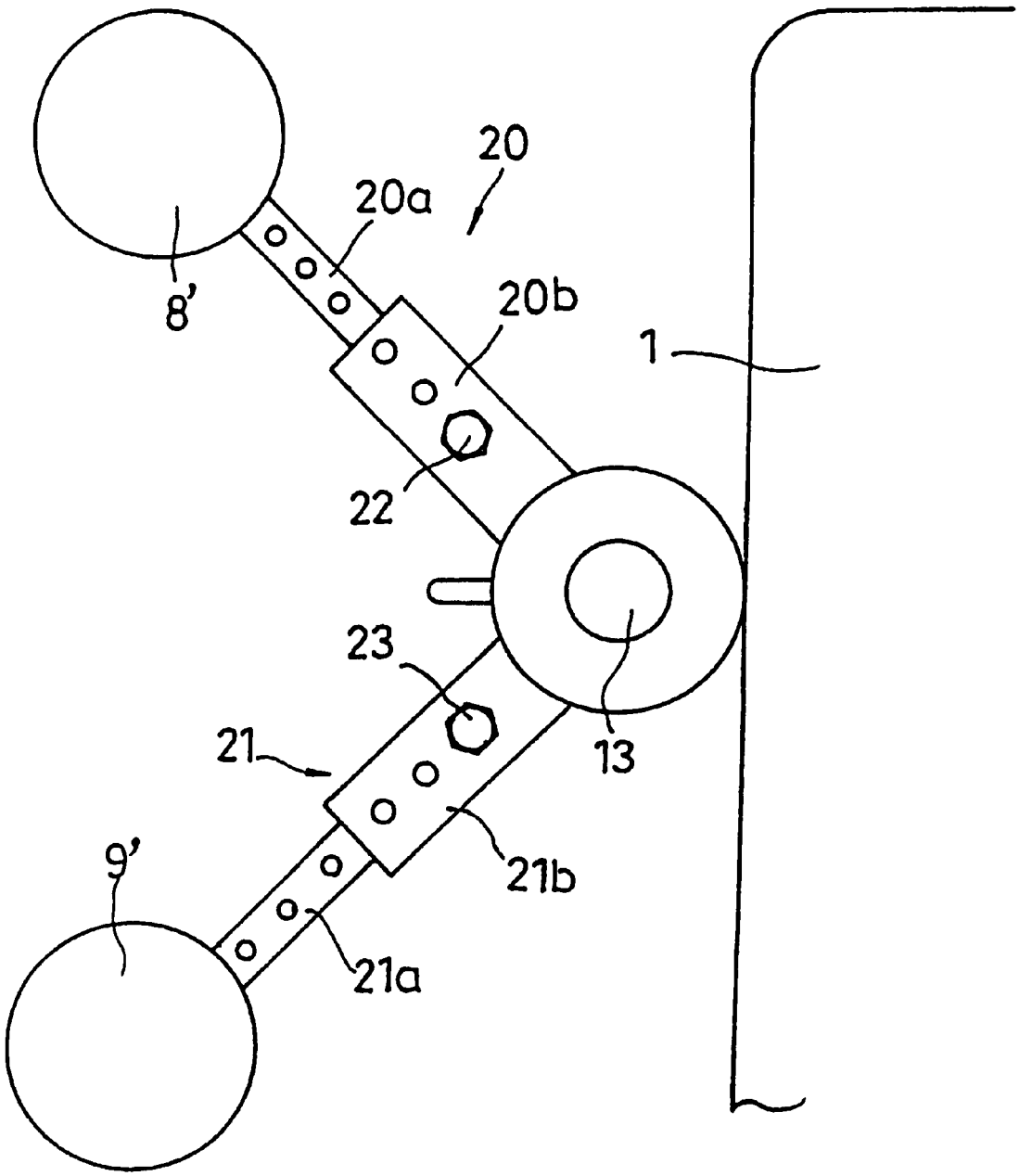
FIG. 8 is a side elevation view showing a sixth embodiment of a back and waist support device for a seating furniture equipment according to the present invention.

Referring now to FIG. 8, even another embodiment of a back and waist support device for a seating furniture equipment according to the present invention is illustrated. In the illustrated embodiment, a first arm 20 and a second arm 21 each are so constructed that a length thereof is adjustable or variable. More particularly, in the illustrated embodiment, the first arm 20 and second arm 21 are divided into two arm members 20*a* and 20*b* and two arm members 21*a* and 21*b*, respectively. The arm members 20*a* and 21*a* each are formed into a reduced thickness or diameter and the arm members 20*b* and 21*b* each are formed into an increased thickness or diameter. The arm members 20*a* and 20*b* are connected to each other at any one of a plurality of connection positions selected as desired by means of a bolt 22, resulting in the first arm 20 being variable in length. Likewise the arm members 21*a* and 21*b* are connected to each other at any one of a plurality of connection positions selected as desired by means of a bolt 23, resulting in the first ann 21 being likewise variable in length. Such construction permits the back and waist support device of the illustrated embodiment to be accommodated to a figure of a user.

Figure 9:
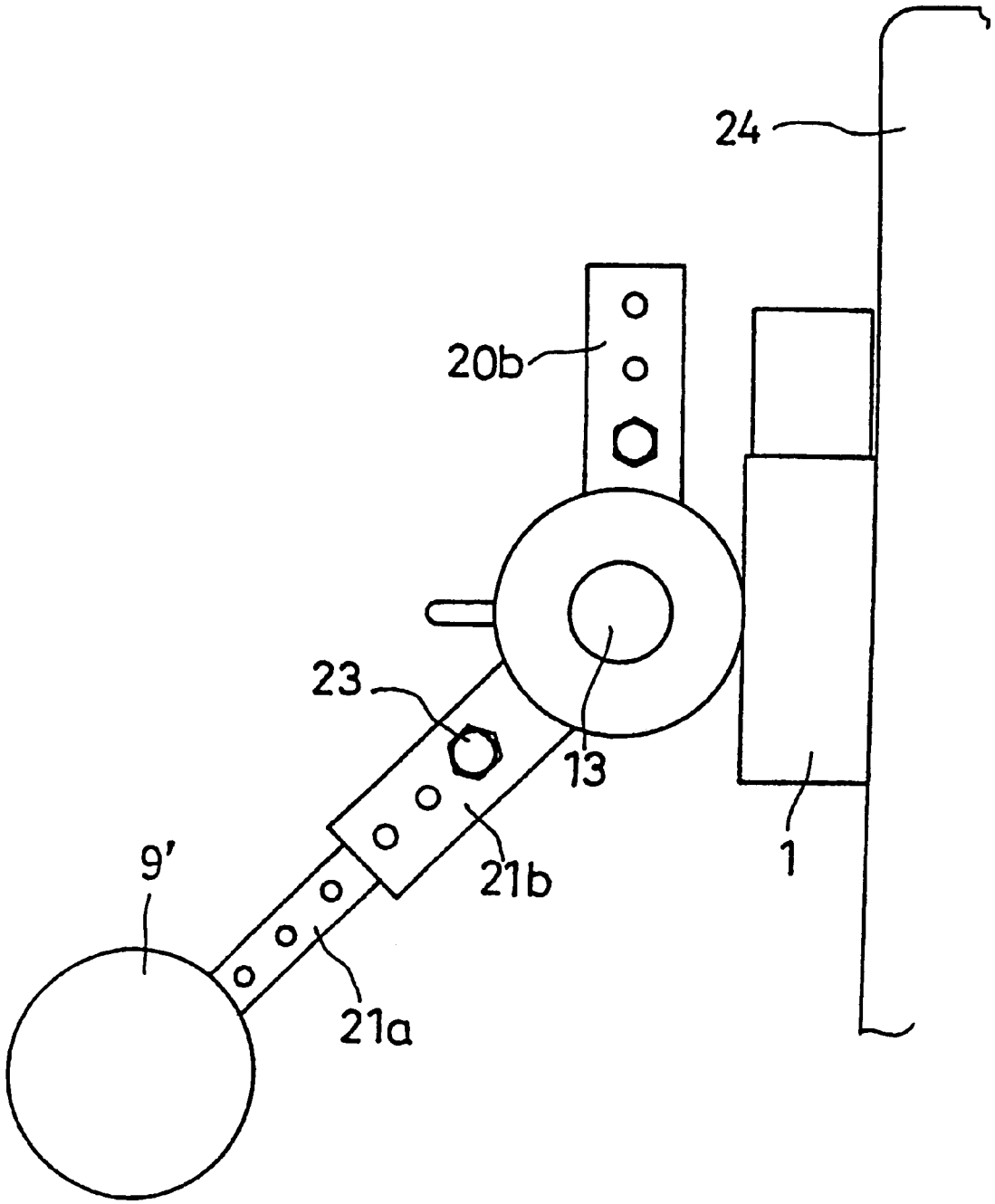
FIG. 9 is a side elevation view showing a seventh embodiment of a back and waist support device for a seating furniture equipment according to the present invention.

Referring now to FIG. 9, a still further embodiment of a back and waist support device for a seating furniture equipment according to the present invention is illustrated. The illustrated embodiment is so constructed that any one of a first projection 8' and a second projection 9' is used. In the illustrated embodiment, an arm member 20*a* reduced in diameter is detached from an arm member 20*b* increased in diameter, so that the first arm 20 is kept from being used.

Figure 10:
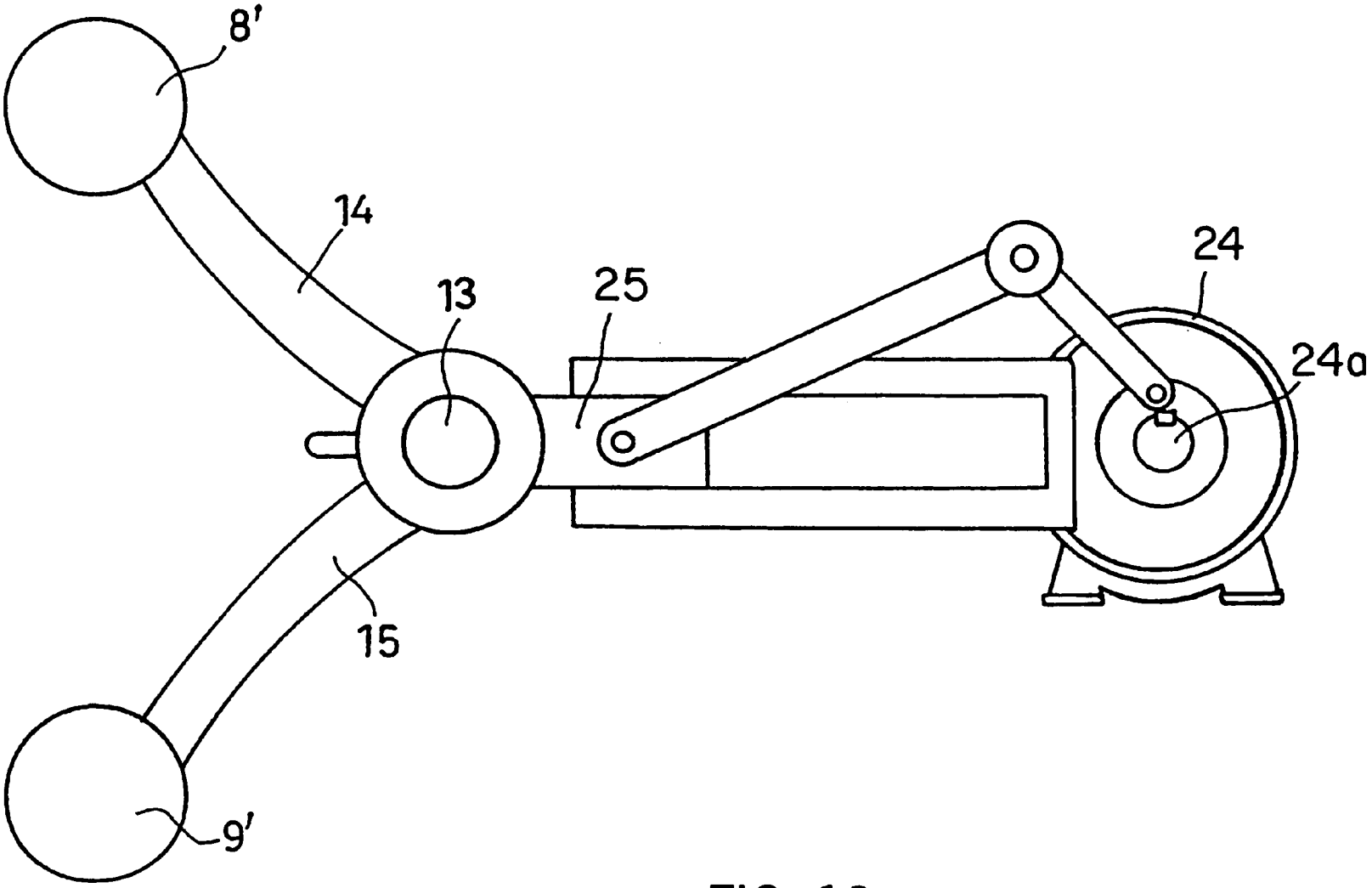
FIG. 10 is a side elevation view showing an eighth embodiment of a back and waist support device for a seating furniture equipment according to the present invention.

Referring now to FIG. 10, a yet further embodiment of a back and waist support device for a seating furniture equipment according to the present invention is illustrated. A back and waist support device of the illustrated embodiment is constructed so as to further promote pressing of a first projection 8' and a second projection 9' against the back of a user and his waist, to thereby further exhibit a massage function. In FIG. 10, a slider crank mechanism is shown by way of example. More particularly, a piston 25 is arranged so as to be reciprocated about a shaft 24*a* of a motor 24, so that a first arm 14 and a second arm 15 may be varied in angle, resulting in a first projection 8' and a second projection 9' massaging the back of a user and his waist, respectively.

Industrial Applicability

As can be seen from the foregoing, the back and waist support device of the present invention permits the first projection and second projection to effectively forcedly press the back of a user and his waist irrespective of a posture of the user such as, for example, his sitting with a slouch, his sitting forward on a seat or the like, so that the user may throw out his chest and stretch his backbone.

What is claimed is:

1. A back and waist support device for a chair having a seating surface and a backrest, comprising a longitudinally extending first projection for supporting the back of a user and a longitudinally extending second projection for supporting the waist of the user, characterized in that:

a first arm is arranged for supporting said first projection wherein the first arm extends laterally from a generally center position of the backrest;

a second arm is arranged for supporting said second projection wherein the second arm extends laterally from a generally center position of the backrest;

springs are arranged on said first arm and second arm so as to urge said first projection and second projection in a direction in which said first and second projections forcedly press the back and waist, respectively;

said first and second arms each are arranged in a manner to be pivotally moved about a separate shaft within a predetermined range, each shaft adapted for attachment to the backrest;

a first base plate interconnected between the first arm and the backrest;

a second base plate interconnected between the second arm and the backrest; and an angle adjusting mechanism disposed between the first base plate and the second base plate to permit the base plates to be pivotally moved and held at any desired angle.

2. A back and waist support device for a chair having a seating surface and a backrest, comprising a longitudinally extending first projection, horizontally positioned for supporting the back of a user and a longitudinally extending second projection, horizontally positioned for supporting the waist of the user, characterized in that:

a first arm is arranged for supporting said first projection;

a second arm is arranged for supporting said second projection; and said first arm and second arm each are pivotally attached to a single shaft, said shaft adapted for operative attachment to the backrest, and each arm comprised of an elastic material to urge said first projection and second projection in a direction in which said first projection and second projection forcedly press the back of a user and his waist, respectively.

3. The device of claim 2 further including a single base plate wherein the base plate is interconnected between the first arm and the backrest and the base plate is also interconnected between the second arm and the backrest.

4. A back and waist support device for a chair having a seating surface and a backrest, comprising a longitudinally extending first projection, horizontally positioned for supporting the back of a user and a longitudinally extending second projection, horizontally positioned for supporting the waist of the user, characterized in that:

a first arm is arranged for supporting said first projection;

a second arm is arranged for supporting said second projection; and said first arm and second arm each are constructed so as to be variable in length, said first arm and second arm are pivotally attached to a single shaft, and said shaft adapted for operative attachment to the backrest.

5. The device of claim 4 wherein the first arm and second arm are divided into two arm members.

6. The device of claim 5 wherein first arm member is telescopingly connected to the second arm member, and provided with a plurality of selective connection positions.

* * * * *